US006267555B1

(12) United States Patent
Chien et al.

(10) Patent No.: US 6,267,555 B1
(45) Date of Patent: Jul. 31, 2001

(54) SHEET METAL CASING FOR MULTISTAGE PUMP AND METHOD FOR MANUFACTURING THE SAME

(75) Inventors: Huan-Jan Chien; Pao-Yin Ou, both of Chutung; Shu-Fen Kao, Taipei; Rong-Jau Liaw, Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/481,407

(22) Filed: Jan. 12, 2000

(51) Int. Cl.[7] ..... F01D 11/00

(52) U.S. Cl. ..... 415/172.1; 415/173.1; 415/200

(58) Field of Search ..... 415/199.1, 172.1, 415/173.1, 200, 182.1

(56) References Cited

U.S. PATENT DOCUMENTS 5,234,317 * 8/1993 Kajiwara et al. ..... 415/200
5,256,033 * 10/1993 Kajiwara ..... 415/199.1
5,318,403 * 6/1994 Kajiwara et al. ..... 415/199.1
5,352,089 * 10/1994 Tokunaga et al. ..... 415/172.1
5,358,380 * 10/1994 Arkawa ..... 415/200
5,385,444 * 1/1995 Kobayashi et al. ..... 415/200

* cited by examiner

*Primary Examiner*—John Kwon
(74) *Attorney, Agent, or Firm*—Dougherty & Troxell

(57) ABSTRACT

A sheet metal casing for multistage pump and its manufacturing method, the casing includes an outer shell and an inner shell. The outer shell is integrally formed and includes a front end ring, a step positioning ring, an outer shell surface and a positioning end. The inner shell is fixed to the inner side of the outer shell and includes an inner end, an inner shell surface and a step positioning rim. The step positioning rim forms a closed holding space with the outer shell surface for holding and squeezing a seal ring therein. When a plurality of casings being serially mounted on a spindle, the positioning end of a front casing may make contact with the step positioning ring of a rear casing, and the positioning rim of the front inner shell may make contact with the front end ring of the rear outer shell for axially positioning the casings on the spindle.

14 Claims, 6 Drawing Sheets

SHEET METAL CASING FOR MULTISTAGE PUMP AND METHOD FOR MANUFACTURING THE SAME

BACKGROUND OF THE INVENTION

1. Field of the Invention

This invention relates to sheet metal casing for multistage pump and its manufacturing method, and particularly to a sheet metal casing for multistage submerged pump that has simple structure to facilitate fabrication and assembly at low cost, and has improved sealing and pumping efficiency.

2. Description of the Prior Art

Conventional multistage centrifugal pumps (such as submerged pumps) usually includes a plurality of casings with passages and impellers housed therein and mounted serially on a rotationable spindle for pumping fluid by adding pressure. The multistage pump made by casting in the past is heavy and bulky and has lower pump efficiency. It is generally replaced by sheet metal casing pump nowadays.

In the design of multistage sheet metal casing pump, the main considerations include: manufacturing and assembly cost, pump efficiency and passage design, pressure resistance, leakage prevention, etc. These factors are rarely totally met by conventional sheet metal casing multistage pump. For instance, European Pat. Application No. 81110541.0 discloses a sheet metal casing structure for multistage pump shown in FIG. 1. It has a casing 11 made by punching and a partition member 12 to form a stage 2 for housing an impeller 3 and baffles 20 therein. The casing 11 has a curved portion 19 for engaging a front stage with a rear stage. At the juncture of the engagement, a seal ring 14 is provided. The dimension and precision of the curved portion 19 is difficult to control. When more than one stage being fastened axially, the positioning of the curved portion 19 is even more difficult and is prone to deform. The seal ring 14 tends to malfunction and result in leakage under pressure or vibration. Moreover there is no smooth passage inside the casing 11 and the impeller 13. It is easy to produce turbulence around the front end 112 during pumping operation and result in lower pump efficiency. In short, it has the drawbacks of poor axial positioning, easy leaking and low pump efficiency.

FIG. 2 illustrates another prior art disclosed in U.S. Pat. No. 5,234,317. It has a pump casing 21 made by punching and pressing. The pump casing 21 has an end rim 211 formed in a U-shaped member for engaging securely with a next stage pump casing. However it has a smaller contact area (sealing surface). The end rim 211 is prone to deform and open outwardly under strong pumping pressure or vibration. Leaking is still not avoidable. Furthermore the pump casing 21 cannot be made by merely punching operation. It needs pressing operation to finish all the fabrication work required. The cost is higher. And there is also no smooth passage inside the casing and may result in turbulence and lower pump efficiency. When two stage pumps are connected, the connection portion forms an S-shaped structure. While it helps to prevent deformation and leakage, it increases production cost.

FIG. 3 shows a still another technique seen in the market place. The pump casing 4 includes a front outer shell 41, a rear outer shell 42, a front inner shell 43, a rear inner shell 44, a hub 46, a front seal ring 47 and an impeller (not shown in the figure). The front outer shell 41 includes a front side ring 413, an axial positioning ring 411 and a radial positioning ring 412. The rear outer shell 42 includes an axial positioning end 421 and a radial positioning end 422 mating respectively with the rings 411 and 412. The rear inner shell 44 has a positioning end 441 at the rear end.

For assembly of a single casing 4, the vane 45 is firstly soldered to the front inner shell 43. Then the front outer shell 41, rear outer shell 42, front inner shell 43 and rear inner shell 44 are assembled together (otherwise the inner shells 43 and 44 cannot be put into the outer shells 41 and 42). Then circular soldering is made on the solder spots 48 around the outer shell.

For assembly of a multistage pump casing 4, the positioning end 44 of a front casing 4 will be made contact with the front side ring 413 of a rear casing. The axial and radial positioning end 421 and 422 of the front casing will be made contact with the axial and radial positioning rings 411 and 412 which may couple with a seal ring to prevent leakage. The front and rear inner shells 43 and 44 have curved inside surface to smooth flow passage and enhance pump efficiency.

However there are still disadvantages in this technique, notably:

1. It has too many components and costs too much to produce. Eight components are required, including the front and rear outer shells 41 and 42 front and rear inner shells 43 and 44, vane 45, hub 46, front seal ring 47 and the impeller. The molding cost and assembly time increase greatly. The hub 46 and front seal ring 47 also add to the cost.

2. It needs secondary machining that increases cost and production time. The axial and radial positioning ring 411 and 412, and the axial and radial positioning end 421 and 422 need high precision machining work to get the accurate dimension for making the required connection. An usual punching operation cannot produce that kind of precision. The machining also unavoidably reduces shell thickness and weaken the structural strength.

3. The circular soldering of the solder spots 48 are much more expensive and time-consuming than conventional spot soldering. It also tends to produce notsightly casing and lower dimension accuracy. Positioning for assembly is more difficult. The soldering property and strength is difficult to control. A secondary machining is needed after the soldering and may reduce casing thickness.

The prior arts set forth above thus cannot totally meet all the design factors such as production and assembly costs, pump efficiency and passage streamline, pressure resistance, leak control and prevention, etc. There are still a lot of room for improvement.

SUMMARY OF THE INVENTION

It is an object of this invention to provide a sheet metal casing for multistage pump and manufacturing method that has lower production and assembly cost, enhanced pressure resistance and improved leakage prevention.

The pump according to this invention consists of a plurality of pump unitsserially mounted on a rotationable spindle. Each pump unit includes a casing, an impeller and a hub. The casing includes an outer shell and an inner shell. The outer shell is integrally formed and includes a front end ring, a step positioning ring, an outer shell surface and a positioning end. The inner shell is located inside the outer shell and includes an inner end, an inner shell surface and a step positioning rim. The positioning rim and the outer shell surface form a holding space inside for holding a seal ring. When a plurality of casings are serially connected, the positioning end of a front casing may contact with the step positioning ring of a rear casing, and the positioning rim of the front casing may contact with front end ring of the rear casing for positioning the casings on the spindle and securing the seal ring in the closed holding space. The front end ring and the inner end are bent and extended forward and are parallel with the spindle with a gap formed therebetween to mate against inlet of the impeller. It also serves sealing function.

The manufacturing method of this invention includes more than one punching operation on a metal sheet to produce the front end ring, step positioning ring and outer shell surface. Then the inner shell is formed by more than one punching operation to form a front half and a rear half sections.

The front half section includes the inner end and about a half of the inner shell surface. The rear half section includes about a half of remaining inner shell surface and the positioning rim. Then the front half section, vane and rear half section are soldered serially to the outer shell. Finally a punching operation is performed on the outer shell to form the positioning end.

BRIEF DESCRIPTION OF THE DRAWINGS

This invention, as well as its many advantages, may be further understood by the following detailed description and drawings, in which.

DETAILED DESCRIPTION OF THE PREFERRED EMBODIMENT

Figure 1:
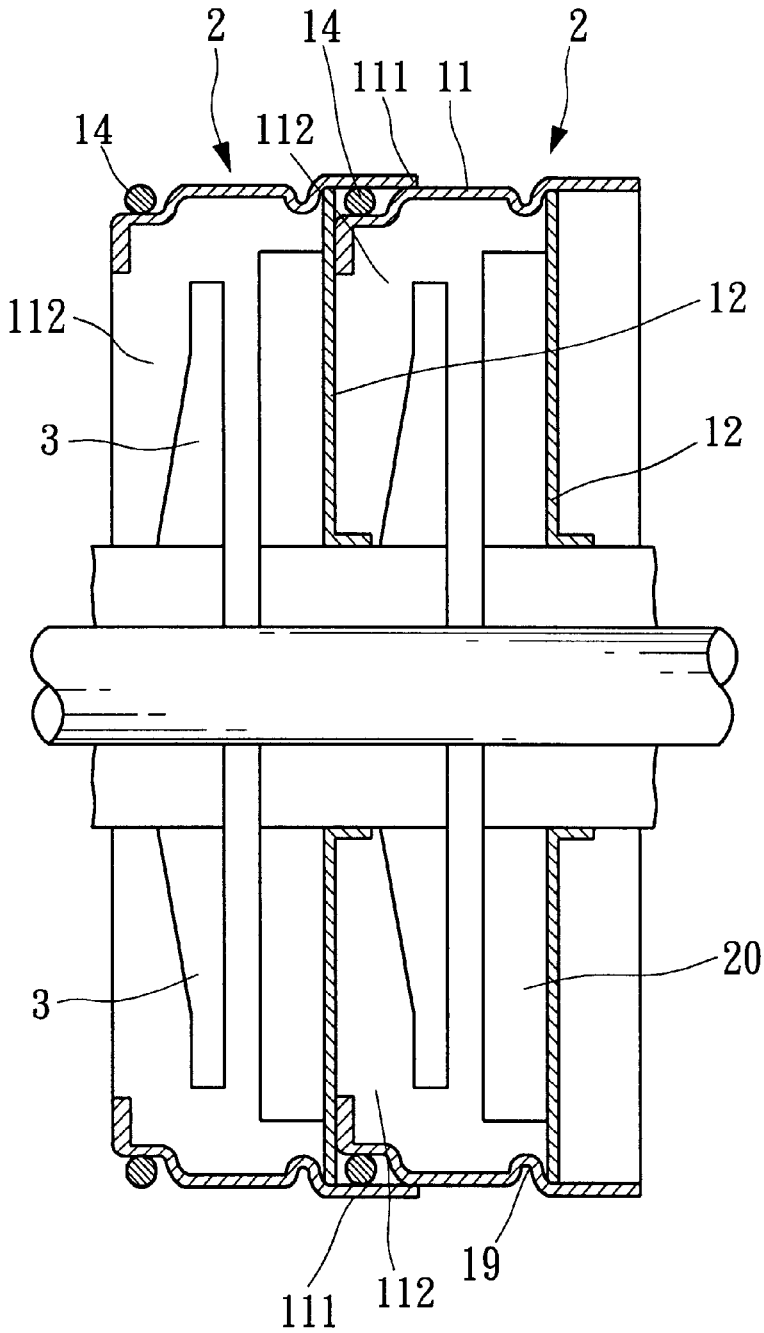
FIG. 1 (PRIOR ART)
FIG. 1 is a sectional view of a conventional sheet metal casing for a multistage pump.
Figure 2:
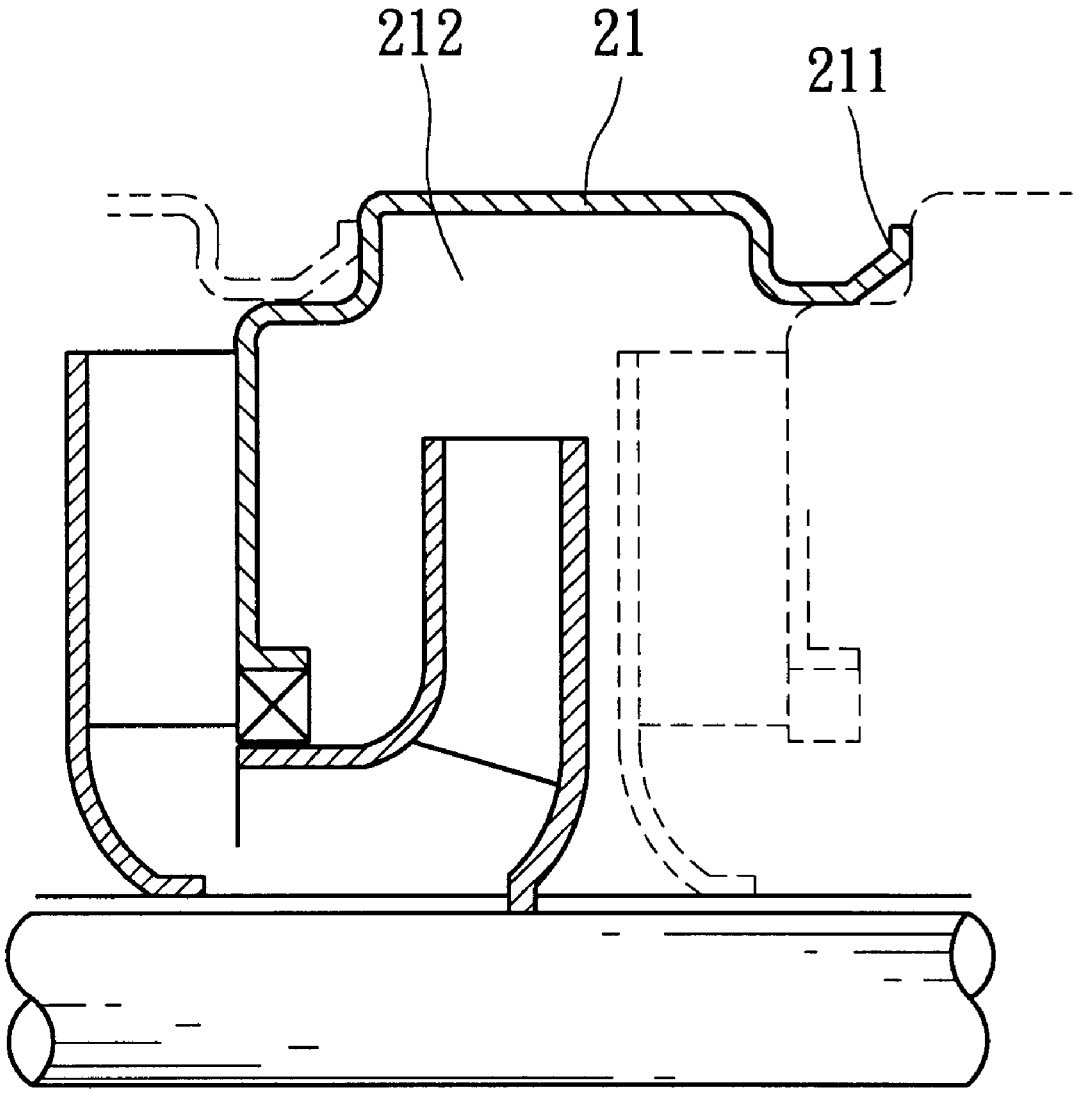
FIG. 2 (PRIOR ART)
FIG. 2 is a fragmentary sectional view of another conventional sheet metal casing for a multistage pump.
Figure 3:
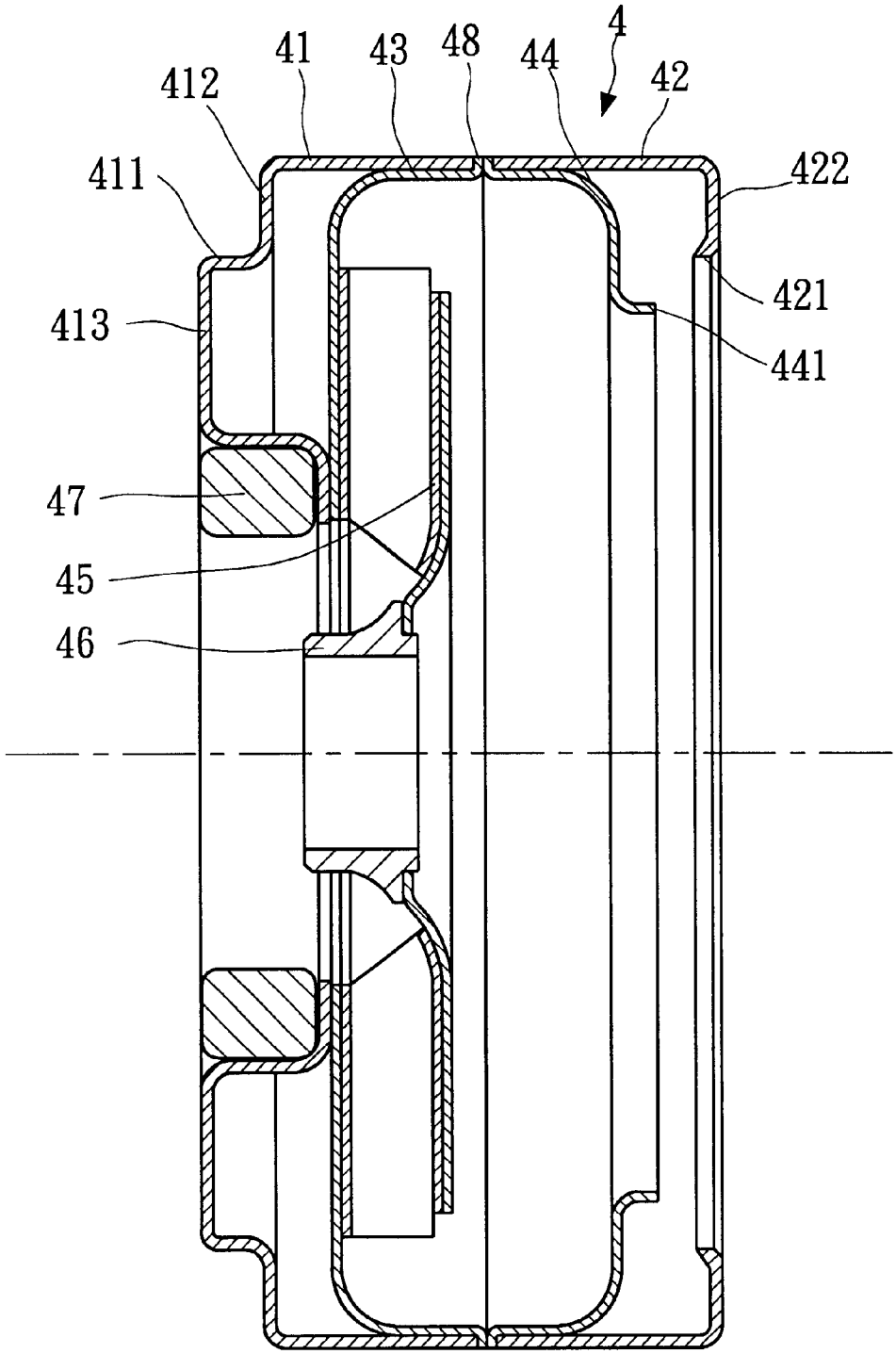
FIG. 3 is a fragmentary sectional view of a further conventional sheet metal casing for a multistage pump.
Figure 4:
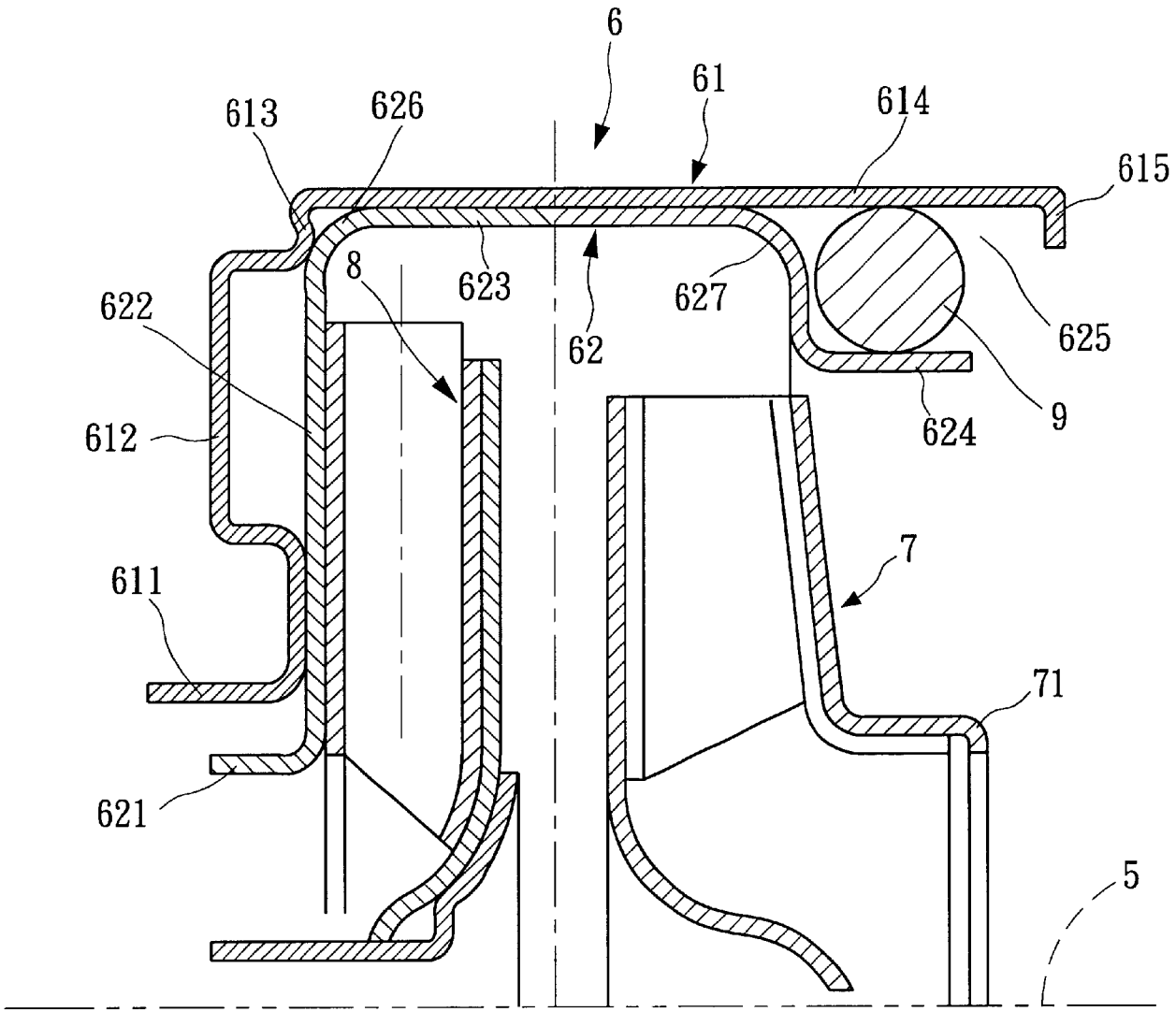
FIG. 4 is a fragmentary sectional view of this invention for a single pump casing.
Figure 5:
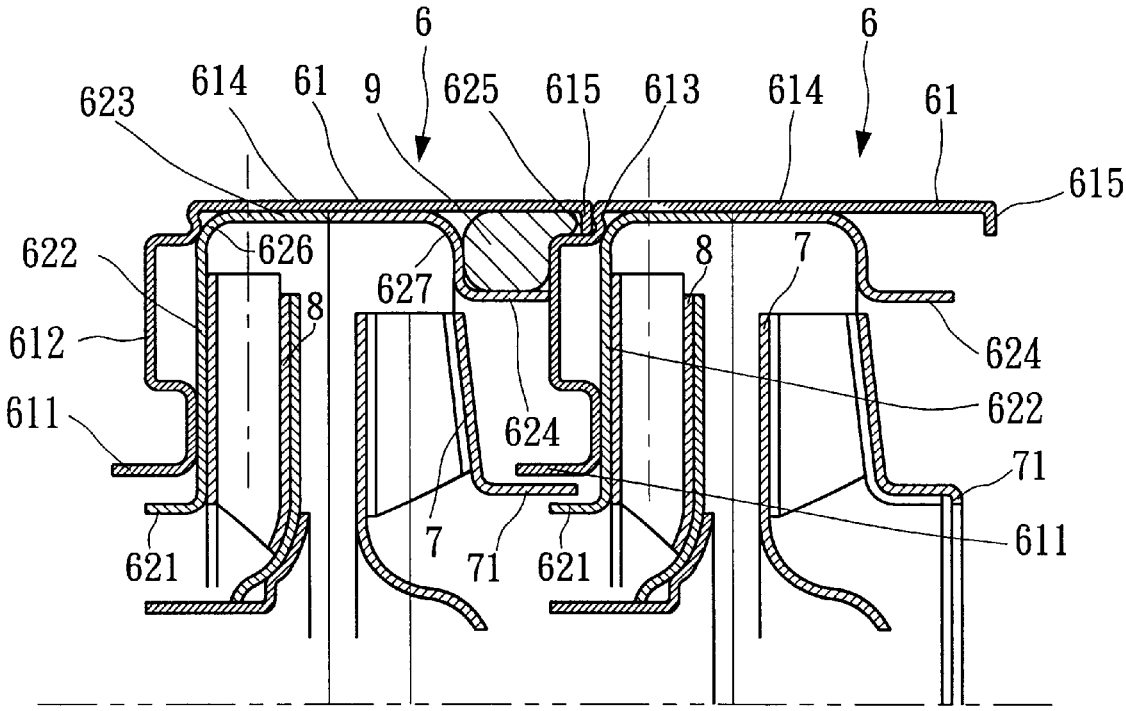
FIG. 5 is fragmentary sectional view of this invention for a two-stage pump.

Referring to FIGS. 4 and 5, the sheet metal casing of this invention consists of a plurality of pump casings 6 serially mounted on a rotationable spindle 5. Each of the pump casings 6 includes a casing, an impeller 7 and a vane 8. The structure of the spindle 5, impeller 7 and vane 8, and their constructional relationship are known in the art and form no part of this invention, thus will be omitted hereinafter.

This invention mainly focuses the pump casing structure and will be described in the following.

Figure 6:
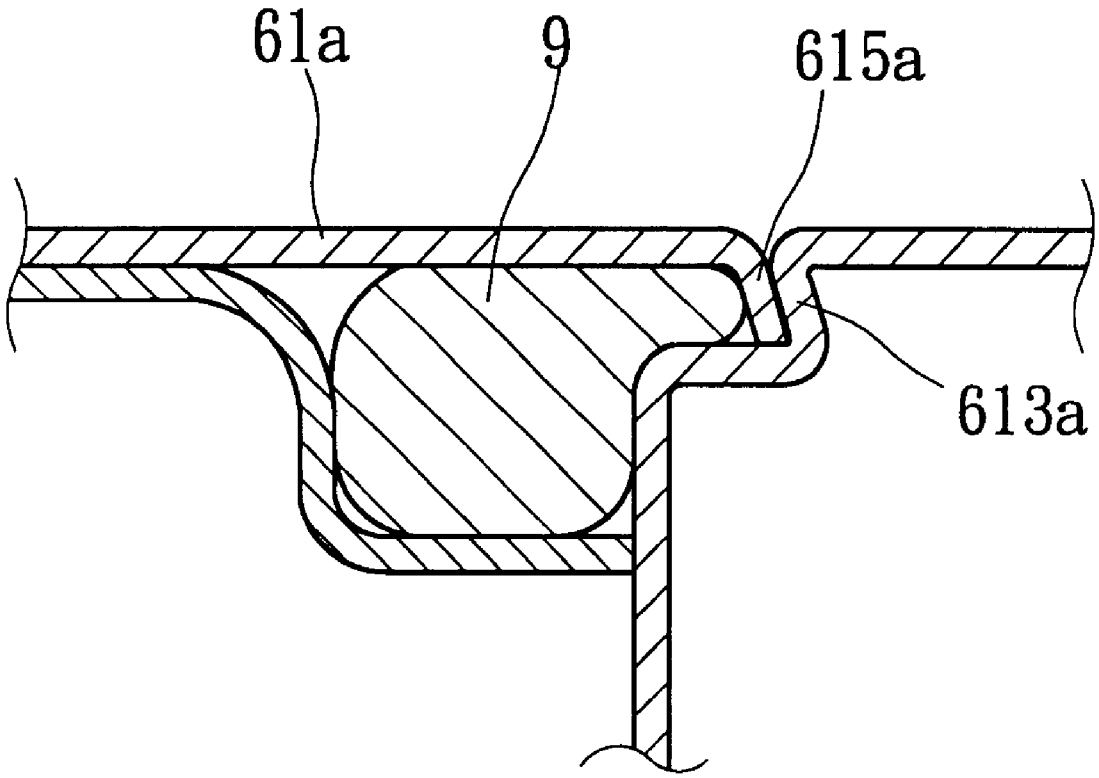
FIG. 6 is a fragmentary sectional view of a positioning end for holding a seal ring.

The pump casing includes an outer shell 61, an inner shell 62 and a seal ring 9. The outer shell 61 is made by punching a sheet metal (such as stainless steel) with more than one operation to form an integrated annular shell shape. It includes (from left to right in FIG. 4) a first front end 611 which extends approximately parallel with the spindle 5 for a selected length, a front end ring 612 extending outward and normal to the spindle 5, a step positioning ring 613 extending outward from the front end ring 612, an outer shell surface 614 extending parallel with the spindle 5 and a positioning end 615 extending inward and nearly normal to the spindle 5 as shown in FIG. 6). The step positioning ring 613 also has a normal or near normal angle.

The inner shell 62 is fixed inside the outer shell 61 and houses the vane 8 therein. The inner shell 62 includes a second front end 621 approximately parallel with the spindle 5, an inner end 622 extending outward and normal to the spindle 5, an inner shell surface 623 approximately parallel with the spindle 5 below the outer shell surface 614 and forms a step elbow inward toward the spindle 5 at a fist curved bend 627, and a positioning rim 624 parallel with the spindle 5. The positioning rim 624 and positioning end 615 form a holding space for holding the seal ring 9 therein. The juncture between the inner end 622 and inner shell surface 623 also forms a second curved bend 626 which couples with the first curved bend 627 to form a smooth fluid passage guide to enable pumping fluid to flow smoothly from the impeller 7 to the vane 8 without producing turbulence.

Referring to FIG. 5, when a plurality of pump casings 6 are assembled serially, the front casing 6 (at the left side in FIG. 5) has its positioning end 615 making contact with the step positioning ring 613 of the rear casing (at the right side in FIG. 5). The positioning rim 624 of the front casing makes contact with the front ending 612 of the rear casing, so that the pump casing 6 may be positioned on the spindle 5 and the space 625 may become closed. The seal ring 9 held in the closed space 625 is squeezed and may prevent leakage effectively. As the positioning end 615 of the front casing engages with a slightly tilted step positioning ring 613 of the rear casing, the deformation of the positioning end 615 under pressure may be minimized and may further prevent leakage from taking place. Furthermore the first front end 611 and second front end 621 form a gap mating with the inlet 71 of the impeller 7 and may also provide impeller sealing function.

FIG. 6 shows another embodiment of the positioning end 615 of this invention. Same or similar components will be marked by same numerals suffixed with a character. The positional end 615*a* is bent slightly larger than 90 degree for wedging with the step positioning ring 613*a*. It forms a more secured sealing and anti-leaking effect than the one shown in FIG. 5. However it needs more precise machining.

The manufacturing method of this invention may include the following steps:

a. punching a sheet metal more than once to form the outer shell 61, including the first front end 611, front end ring 612, step positioning ring 613 and outer shell surface 614;

b1. Punching two metal sheets more than once to form the front and rear half section of the inner shell 62. The front half section includes the second front end 621, inner end 622 and about a half of the inner shell surface 623. The rear half, section includes about a half of the inner shell surface 623 and positioning rim 624.

b2. Placing the front half section of the inner shell 62 and the vane 8 into the outer shell 62 from a rear end thereof, soldering the vane 8 to the front half section.

b3. Placing the rear half section of the inner shell 62 into the outer shell 61 from the rear end thereof;

Soldering the front and rear half section together to form a complete inner shell 62 and fixing the inner shell 62 to the inner side of the outer shell surface 614.

c. punching the outer shell surface 614 to form the positioning end 615.

According to this invention, the outer shell 61 and inner shell 62 have relatively simple form. They are simpler to produce and assemble at lower cost. The positioning end 615 is formed after the inner shell 62 is fixed in the outer shell 61. It may be made with simpler mold at higher precision. It thus can sustain high pressure without deformation or leakage. The engagement of the positioning end 615 with the step positioning ring 613 is also more secure, and can effectively prevent leakage under high pressure even with less than perfect fabrication precision of the pump casing. The seal ring 9 held in a closed space 625 can further improve anti-leaking effect. The curved bend 626 and 627 provide smooth passage guide to streamline fluid flow without generating turbulence and thus may enhance pump efficiently. Almost all the shortcomings resulting from conventional pump casing thus may be overcome by means of this invention. In summary, this invention offers the following advantages:

1. Small number of components.

As shown in FIGS. 4 and 5, the pump casing 6 of this invention includes an outer shell 61, an inner shell 62 (with a front and a rear section), a vane 8 and an impeller. It takes only five components comparing with eight in the conventional pump casing mentioned before. Positioning and assembly become much easier. At least four molds may be saved for producing the components. Production cost thus may be greatly reduced. The sealing between the hub and the front seal ring may be done without additional features. It also helps to drive cost down.

2. No need for secondary high precision machining.

The sealing effect from the positioning end 615 and step positioning ring 613 and the seal ring 9 is simple and effective with no need of precision machining. The production cost becomes lower.

3. No need for circular soldering.

The outer shell 61 is one piece made integrally. Spot soldering is sufficient to accomplish required bonding strength. It costs lower, makes sightly appearance and stronger structural strength. Spot soldering also has less impact on pump casing deformation and mechanical strength of the material, it thus makes secondary machining for the step positioning ring 613 and positioning end 615 unnecessary.

It may thus been seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skill in the art. Accordingly, the appended claims are intended to cover all embodiments which do not depart from the spirit and scope of the invention.

What is claimed is:

1. A sheet metal casing for multistage pump which consists a plurality of pump casings serially mounted on a rotationable spindle, the pump casing includes a casing, an impeller and a vane, the casing comprising;

an annular outer shell made by integral forming including at least, starting from one end thereof, a front end ring approximately normal to the spindle and extending outward, a step positioning ring having one end thereof connecting with the front end ring, an outer shell surface extending nearly parallel with the spindle and a positioning end connecting with an end of the outer shell surface and extending toward the spindle;

an inner shell fixedly located in the outer shell and housed the vane therein, including at least, starting from an end adjacent the front end ring, an inner ring approximately normal to the spindle and extending outward, an inner shell surface approximately parallel with the spindle, and a step positioning end connection with inner shell surface at one end thereof, the step positioning end forming a holding space with the outer shell surface; and a seal ring held in the holding space;

wherein the front end ring has a first front end bent parallel with the spindle and extending forward, the inner end has a second front end bent parallel with the spindle and extending forward, the first and second front ends form a gap therebetwen mating with an inlet of the impeller for sealing the impeller.

2. The sheet metal casing for multistage pump of claim 1, wherein the positioning end of a front pump casing makes contact with the step positioning ring of a rear pump casing, and the positioning rim of the front pump casing makes contact with the front end ring of the rear pump casing to form a closed space to hold the squeezed seal ring therein for preventing leakage.

3. The sheet metal casing for multistage pump of claim 1, wherein the positioning end has a surface formed an approximately ninety degree angle radially against the outer shell surface for mating and contacting with the step positioning ring of the rear adjacent pump casing to prevent leaking under high pumping pressure.

4. The sheet metal casing for multistage pump of claim 1, wherein the inner shell surface forms respectively with the inner end and positioning rim a first and a second curved bend to become curved passage guide to streamline fluid flow from the impeller to the vane for preventing turbulence.

5. The sheet metal casing for multistage pump of claim 1, wherein the positioning end forms an angle with the outer shell surface larger than ninety degree, the step positioning ring has a bending angle less than ninety degree for mating and contacting with the positioning end so that the positioning end wont deform outward under high pumping pressure.

6. The sheet metal casing for multistage pump of claim 1, wherein the vane is fixedly located on the inner end within the inner shell.

7. A manufacturing method for fabricating the sheet metal casing of claim 1, comprising the following steps:

a. punching a sheet metal more than once to form the front end ring, step positioning ring and the outer shell surface;

b. placing the inner shell which has the vane located therein into the outer shell through a rear end thereof and soldering the inner shell to the outer shell; and c. punching a rear end of the outer shell surface to form the positioning end.

8. The manufacturing method of claim 7, wherein the step b further includes the following:

b1. Punching more than once two separate metal sheets to form a front and a rear section of the inner shell, the front section including at least the inner end and approximately a half of the inner shell surface, the rear section including at least approximately a half of the inner shell surface and the positioning end;

b2. Placing the front section and a front end of the vane into the outer shell at a selected location behind an inside end of the outer shell, the vane being soldered to the front section before being moved into the outer shell; and b3. Placing the rear section into the outer shell to connect with the front section by soldering to form the inner shell, fixing the inner shell to an inner side of the outer shell surface.

9. A sheet metal casing for multistage pump which consists a plurality of pump casings serially mounted on a rotationable spindle, the pump casing includes a casing, an impeller and a vane, the casing comprising;

an outer shell engaged with an inner shell;

an annular outer shell made by integral forming including at least, starting from one end thereof, a front end ring approximately normal to the spindle and extending outward, a step positioning ring having one end thereof connecting with the front end ring, an outer shell surface extending nearly parallel with the spindle and a positioning end connecting with an end of the outer shell surface and extending toward the spindle;

an inner shell fixedly located in the outer shell and housed the vane therein, including at least, starting from an end adjacent the front end ring, an inner ring approximately normal to the spindle and extending outward, an inner shell surface approximately parallel with the spindle, and a step positioning end connection with inner shell surface at one end thereof, the step positioning end forming a holding space with the outer shell surface; and wherein the front end ring has a first front end bent parallel with the spindle and extending forward, the inner end has a second front end bent parallel with the spindle and extending forward, the first and second front ends form a gap therebetwen mating with an inlet of the impeller for sealing the impeller.

10. The sheet metal casing for multistage pump of claim 9 further having a seal ring located in the holding space, the seal ring being squeezed when the pump casings being serially mounted for preventing leakage.

11. The sheet metal casing for multistage pump of claim 9 wherein the positioning end has a surface formed an approximately ninety degree angle radially against the outer shell surface for mating and contacting with the step positioning ring of the rear adjacent pump casing to prevent leaking under high pumping pressure.

12. The sheet metal casing for multistage pump of claim 9, wherein the inner shell surface forms respectively with the inner end and positioning rim a first and a second curved bend to become curved passage guide to streamline fluid flow from the impeller to the vane for preventing turbulence.

13. The sheet metal casing for multistage pump of claim 9, wherein the positioning end forms an angle with the outer shell surface larger than ninety degree, the step positioning ring has a bending angle less than ninety degree for mating and contacting with the positioning end so that the positioning end wont deform outward under high pumping pressure.

14. The sheet metal casing for multistage pump of claim 9, wherein the vane is fixedly located on the inner end within the inner shell.

* * * * *